US007963508B1

(12) United States Patent
McGuffin

(10) Patent No.: US 7,963,508 B1
(45) Date of Patent: Jun. 21, 2011

(54) METHOD AND APPARATUS FOR DIGESTING SLUDGE

(76) Inventor: Thomas R. McGuffin, Pensacola, FL (US)

( * ) Notice: Subject to any disclaimer, the term of this patent is extended or adjusted under 35 U.S.C. 154(b) by 243 days.

(21) Appl. No.: 12/455,238

(22) Filed: Jun. 1, 2009

(51) Int. Cl.
*B01F 3/04* (2006.01)

(52) U.S. Cl. ..... 261/77; 210/221.2; 210/758; 261/123; 261/124

(58) Field of Classification Search ..... 261/30, 261/77, 122.1, 122.2, 123, 124; 210/150, 210/151, 220, 221.1, 221.2, 758; 209/164, 209/168–170
See application file for complete search history.

(56) References Cited

U.S. PATENT DOCUMENTS

| | | | | |
|---|---|---|---|---|
| 3,193,260 | A * | 7/1965 | Lamb | 261/64.1 |
| 3,228,526 | A * | 1/1966 | Ciabattari et al. | 210/221.1 |
| 3,957,442 | A * | 5/1976 | Yamamoto et al. | 422/202 |
| 4,070,423 | A * | 1/1978 | Pierce | 261/77 |
| 4,107,240 | A * | 8/1978 | Verner et al. | 261/77 |
| 4,210,613 | A * | 7/1980 | Webb | 261/120 |
| 4,329,227 | A * | 5/1982 | Todd | 210/220 |
| 4,486,361 | A * | 12/1984 | Durot et al. | 261/123 |
| 4,707,308 | A | 11/1987 | Ryall | |
| 4,863,644 | A * | 9/1989 | Harrington et al. | 261/77 |
| 4,919,849 | A * | 4/1990 | Litz et al. | 261/36.1 |
| 5,249,688 | A * | 10/1993 | Hwang | 209/170 |
| 5,520,714 | A * | 5/1996 | Muschelknautz | 96/349 |
| 5,755,976 | A | 5/1998 | Kortmann | |
| 5,972,661 | A * | 10/1999 | Kubera et al. | 435/104 |
| 6,032,931 | A * | 3/2000 | Plunkett | 261/77 |
| 7,267,328 | B2 | 9/2007 | Witheridge | |
| 2001/0013666 | A1 | 8/2001 | Nomura et al. | |
| 2007/0182033 | A1 * | 8/2007 | Lipert | 261/77 |
| 2008/0017574 | A1 | 1/2008 | Lenger et al. | |

FOREIGN PATENT DOCUMENTS

JP 54-125861 A * 9/1979

* cited by examiner

*Primary Examiner* — Richard L Chiesa
(74) *Attorney, Agent, or Firm* — George L. Williamson

(57) ABSTRACT

A method and apparatus for aerating liquid which includes an aeration chamber having an inlet port at its lower end an outlet port at its upper end wherein the chamber is divided into multiple internal chambers using a plurality of internal divider walls. The chamber is weighted with a base member so that it will not float. Air is inlet at its upper end through an air inlet hole into an upper air manifold wherein the air then travels downwardly through an air feed pipe to a plurality of air outlet holes wherein the air is released and rises thereby causing a flow of material through the inlet ports upwardly along the internal divider walls and aeration chamber and then out of the chamber at its upper outlet port so that the stream of material is directed onto a series of stationary concentric ridges wherein the solids in the liquid material are forcefully impacted against the stationary concentric ridges so as to break the solid particles up into smaller particles.

11 Claims, 3 Drawing Sheets

METHOD AND APPARATUS FOR DIGESTING SLUDGE

BACKGROUND OF THE INVENTION

1. Field of the Invention

The present invention relates generally to aeration devices and, more particularly, is concerned with an aerator for digesting sludge.

2. Description of the Prior Art

Aerators have been described in the prior art, however, none of the prior art devices disclose the unique features of the present invention.

In U.S. Pat. No. 7,267,328 dated Sep. 11, 2007, Witheridge disclosed an aerator for wastewater ponds using airlift pumps. In U.S. Pat. No. 5,755,976 dated May 26, 1998, Kortmann disclosed a pneumatic bubble aeration reactor and method of using same. In U.S. Patent Application Publication 2001/0013666 dated Aug. 16, 2001, Nomura, et al., disclosed a gas/liquid mixing device. In U.S. Pat. No. 4,707,308 dated Nov. 17, 1987, Ryall disclosed an apparatus for circulating water. In U.S. Patent Application Publication 2008/0017574 dated Jan. 24, 2008, Lenger, et al., disclosed a device for in situ bioremediation of liquid waste.

While these aerators may be suitable for the purposes for which they were designed, they would not be as suitable for the purposes of the present invention as hereinafter described.

SUMMARY OF THE PRESENT INVENTION

The present invention discloses a method and apparatus for aerating liquid which comprises an aeration chamber having an inlet port at its lower end an outlet port at its upper end wherein the chamber is divided into multiple internal chambers using a plurality of internal divider walls. The chamber is weighted with a base member so that it will not float. Air is inlet at its upper end through an air inlet hole into an upper air manifold wherein the air then travels downwardly through an air feed pipe to a plurality of air outlet holes wherein the air is released and rises thereby causing a flow of material through the inlet ports upwardly along the internal divider walls and aeration chamber and then out of the chamber at its upper outlet port so that the stream of liquid containing the solid material is directed onto a series of stationary concentric ridges wherein the solids in the liquid material are forcefully impacted against the stationary concentric ridges so as to break the solid particles up into smaller particles.

An object of the present invention is to aerate and break up solid particles in a liquid containing high solids content typical of sewage type waste. A further object of the present invention is to aerate the liquids contained in a sewage lift station. A further object of the present invention is to improve the efficiency of sludge digestion over devices which are currently available on the market so that the operation and maintenance costs of the devices can be reduced. A further object of the present invention is to provide an aerator which can be easily and simply operated by an operator. A further object of the present invention is to provide an aerator which can be simply and relatively inexpensively manufactured. A further object of the present invention is to facilitate the nitrification process. Nitrification is the oxidation of ammonia to a nitrite and then a nitrate, i.e. ammonia ($NH_3$) converts to a nitrite ($NO_2$) which in turn converts to a Nitrate ($NO_3$). A further object of the present invention is to remove deadly hydrogen sulfide gas ($H_2S$) and other VOC'S (volatile organic compounds) without the use of chemicals. A further object of the present invention is to remove most heavy metals which occur naturally in water.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
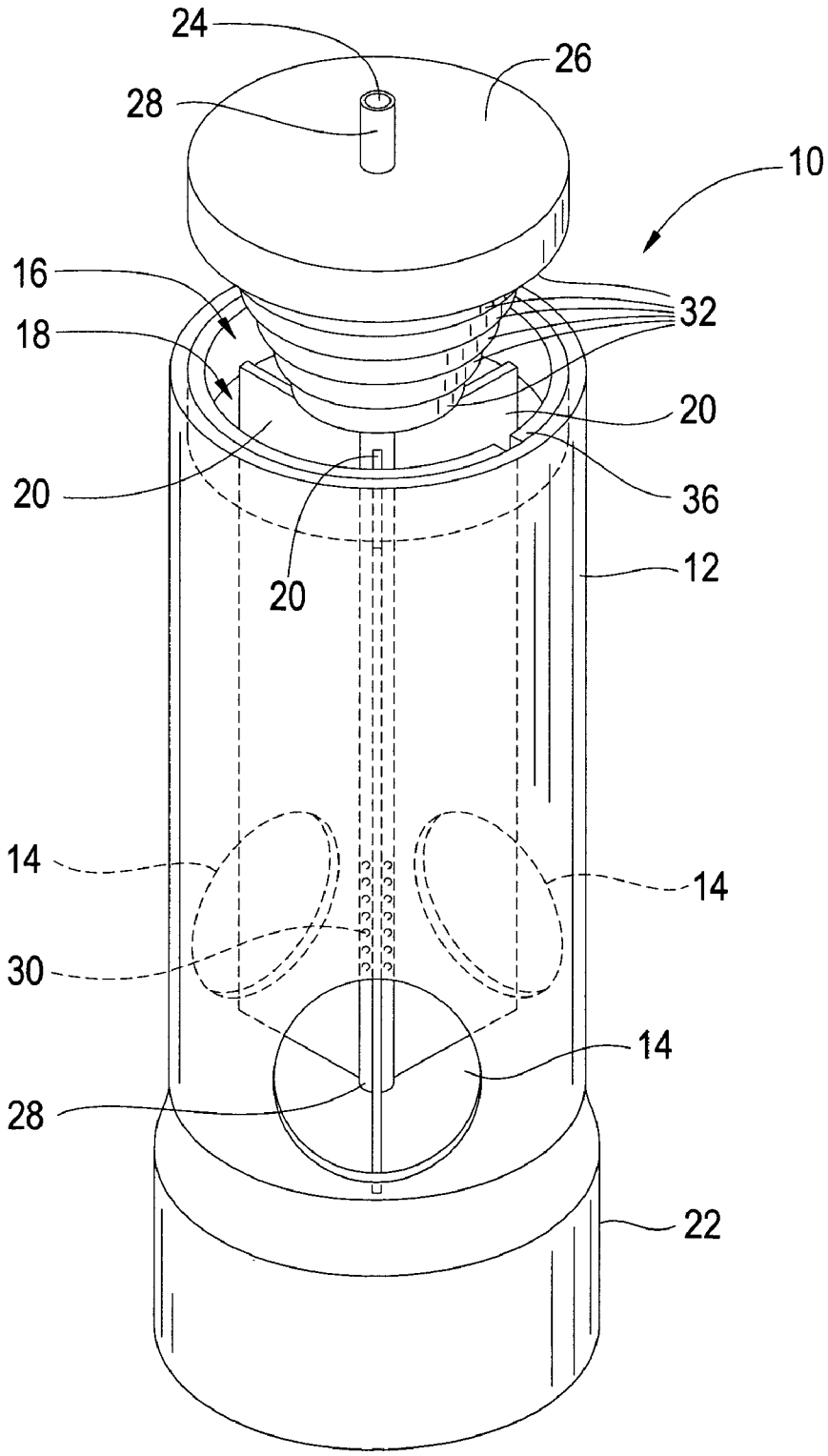
FIG. 1 is a perspective view of the present invention.

With regard to reference numerals used, the following numbering is used throughout the drawings.

10 present invention
12 aeration chamber
14 inlet port for solids and liquids
16 outlet port for solids and liquids
18 internal chamber
20 internal walls/chamber dividers
22 base
24 air inlet
26 air manifold
28 air feed conduit
30 air outlet apertures
32 concentric ridges
34 bore
36 internal lock ring
38 floor
40 wall
42 surface of liquid
44 direction arrow
46 sludge particles
48 pump
50 conduit
52 conduit

DETAILED DESCRIPTION OF THE PREFERRED EMBODIMENT

Figure 2:
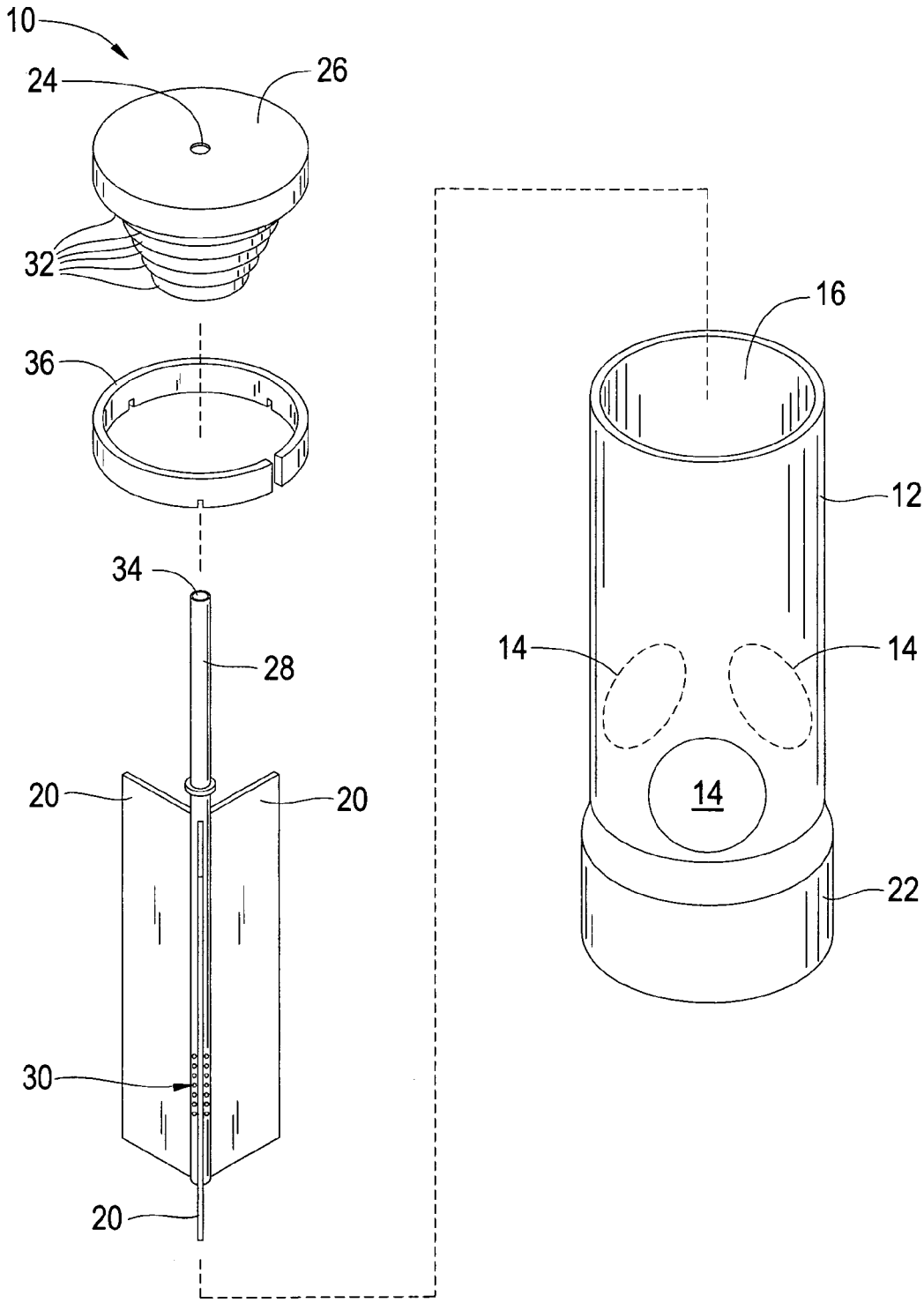
FIG. 2 is an exploded view of the present invention.
Figure 3:
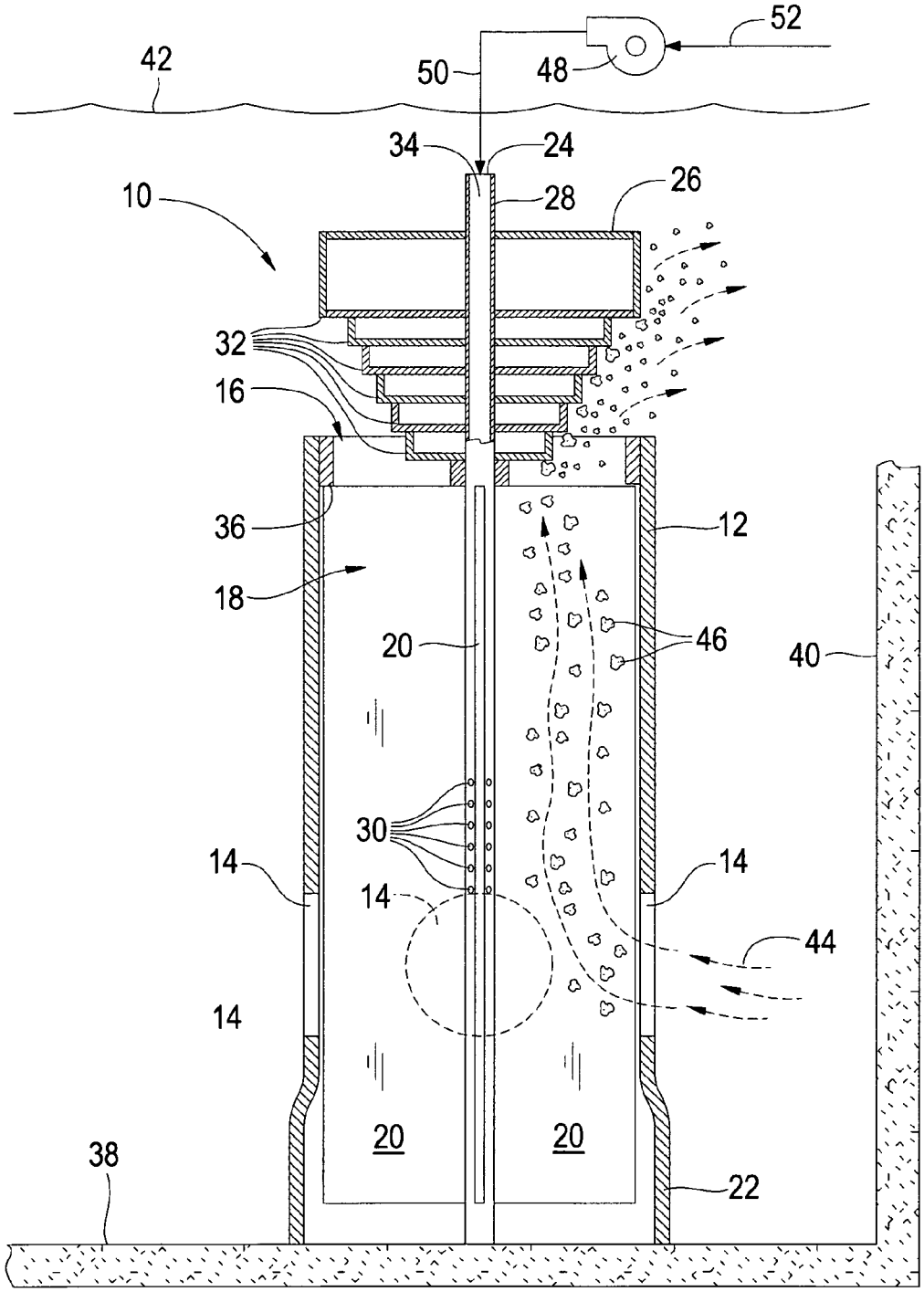
FIG. 3 is a cross sectional view of the present invention.

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 3 illustrate the present invention wherein a method and apparatus for aerating liquids is disclosed.

Turning to FIG. 1, therein is shown the present invention 10 having an upwardly disposed aeration chamber 12, which may be cylindrically shaped, being somewhat elongated to assure aeration, having multiple liquid inlet ports 14 at its lower end and a circumferential liquid outlet port 16 at its upper end wherein the chamber is divided into multiple internal partitions or chambers 18 using a plurality of internal divider walls 20. In FIG. 1, by way of example, there are three internal chambers 18 illustrated which are formed by three walls, 20; however, the number of internal chambers could vary. Each internal chamber 18 has an associated inlet 14 and outlet 16 therein. The chamber 12 is effectively weighted at its lower end with a base member 22 so that it will not float but will remain substantially stationary. Base 22 may weigh about 20 pounds and be made of concrete or the like. Air is inlet at its upper end through an air inlet hole 24 into an upper air manifold 26 wherein the air then travels downwardly through an air feed pipe/conduit 28 to a plurality of air outlet holes/apertures 30 wherein the air is released and rises thereby causing a circular-like flow of liquid and solid material through the inlet ports 14 upwardly along the internal wall/chamber dividers 20 and aeration chamber 12 and then out of the chamber at its upper outlet port 16 so that the stream of liquid material containing the solids is directed onto the series of stationary concentric ridges 32 wherein the solids in the liquid material are forcefully impacted or impinged against the stationary series of concentric ridges so as to break the larger solid particles up into smaller particles which impingement also improves mixing and thereby the oxygen transfer rate. The air pressure in conduit 28 is expected to range from 2 to 50 psi, and, more particularly is about 5 psi. The velocity of the liquid material as it impinges against ridges 32 is expected to range from 45 to 65 feet per second (fps), and, more particularly is about 50 fps. The air pressure in conduit 28 has an effective value to aerate the liquid and the velocity has an effective value to impinge the liquid against the ridges with enough force so as to break down the solids in the liquid into smaller solids. The ridges 32 are stair-stepped so that each successively higher ridge, i.e., toward the upper end of chamber 12, has a greater diameter than the preceding ridge. In FIG. 1, by way of example, six ridges 32 are illustrated; however, the number of ridges could vary. Outlet 16 encircles manifold 26; i.e., manifold 26 is substantially centrally disposed in aeration chamber 12 and outlet port 16, so that the ridges 32 on the manifold form a centrally disposed impingement member to assure maximum impingement of solids against ridges 32, i.e., impingement member. Internal lock ring 36 is shown which assists in securing the top of the walls 20 inside the chamber 12.

Turning to FIG. 2, therein is shown the present invention 10 having an upwardly disposed cylindrical aeration chamber 12 being a walled chamber having upper and lower ends having multiple inlet ports 14 at its lower end and a circumferential outlet port 16 at its upper end wherein the chamber is divided into multiple internal partitions or chambers 18 using a plurality of internal divider walls 20. The chamber 12 is weighted with a base member 22 so that it will not float and remain substantially stationary. Air is inlet at its upper end through an air inlet hole 24 into an upper air manifold 26 wherein the air then travels downwardly through an air feed pipe 28 to a plurality of air outlet holes 30 wherein the air is released and rises thereby causing a flow of material through the inlet ports 14 upwardly along the internal divider walls 20 and aeration chamber 12 and then out of the chamber at its upper outlet port 16 so that the stream of material is directed onto the series of stationary concentric ridges 32 wherein the solids in the liquid material are forcefully impacted against the stationary concentric ridges so as to break the larger solid particles up into smaller particles. Walls 20 project radially from and may be integrally formed with the feed pipe 28 wherein the ends of the walls are substantially contiguous with or in close proximity to the wall of chamber 12 wherein the number of walls equal the number of partitions 18. Ring 36 is shown which assists in securing the top of the walls 20 inside the chamber 12. Feed pipe 28 has a bore 34 therein.

Turning to FIG. 3, therein is shown the present invention 10 having an upwardly disposed cylindrical aeration chamber 12 having multiple inlet ports 14 at its lower end and a circumferential outlet port 16 at its upper end wherein the chamber is divided into multiple internal chambers 18 using a plurality of internal divider walls 20. The chamber 12 is weighted with a base member 22 so that it will not float and remain substantially stationary. Air is inlet at its upper end through an air inlet hole 24 into an upper air manifold 26 wherein the air then travels downwardly through an air feed pipe 28 to a plurality of air outlet holes 30 wherein the air is released and rises thereby causing a flow of material through the inlet ports 14 upwardly along the internal divider walls 20 and aeration chamber 12 and then out of the chamber at its upper outlet port 16 so that the stream of material is directed onto the series of stationary concentric ridges 32 wherein the solids in the liquid material are forcefully impacted against the stationary concentric ridges so as to break the larger solid particles up into smaller particles. Ring 36 is shown which assists in securing the top of the walls 20 inside the chamber 12. Feed pipe 28 has a bore 34 therein. Also shown are floor 38 and wall 40 of the vessel/tank holding the liquid and the liquid level 42. Also shown is the flow pattern set up by the aeration in the present invention shown by the liquid flow direction arrows 44. Also shown are the sludge particles 46 being impinged against ridges 32 so as to be broken up from larger into smaller particles, the air pump 48 and the air outlet conduit 50 for conveying air from the pump to the present invention and the air intake conduit 52 for inletting air into the pump.

The present invention may be portable or permanently installed, or an independently floating device used to mix, mutilate, blend, aerate, break down, emulsify, digest, reduce, eliminate and pre-treat raw sewage in new or existing septic tanks, wastewater treatment tanks, lift stations or the like and is constructed of 100% non corrosive material, e.g., PVC, with no electrical components or moving parts. The present invention eliminates pumping out and removal of old solid waste build-up in existing septic tanks and also aids in opening of clogged drain field lines. Another primary use of the present invention is for a pre-treatment tank for sewage before it enters municipal waste water plants, converting nitrites to nitrates and reducing ammonia, reducing hydrogen sulfide, and other volatile organic compounds which occur naturally in waste water; and, for removal of most heavy metals which naturally occur.

The present invention is constructed of heavy duty PVC, has no moving parts, requires no maintenance, and has no electrical components. With these unique features, the present invention is excellent for chemical mixing in a multitude of applications in industrial plants. Because of its unique features, and the fact that it requires no service or maintenance after installation, this unit is excellent for in-ground, permanently installed pre-treatment waste water tanks including pre-treatment tanks in commercial and residential communities which are on municipal waste water and sewer systems. The present invention can also be used to reduce mosquito breeding areas.

The present invention is also excellent for highly corrosive chemical distribution and mixing in a multitude of industrial applications. The present invention greatly reduces heavy metals and various organic compounds such as nitrites and ammonia through its unique ability to maximize oxygen transfer between oxygen and water molecules which is accomplished by using a specially designed air manifold. Its specific combination of aeration under a pre-determined combination of water and air pressure, in a confined area, facilitates the maximum transfer between oxygen and water molecules. This process creates the maximum dissolved oxygen required to break down raw sewage.

The present invention has a unique way of breaking up solids with no moving parts. Air is injected at a specific depth inside a hollow housing constructed of non-corrosive material through a specially designed air manifold. At the top of the housing is another air manifold which is constructed of heavy duty non-corrosive material. This top manifold has stationary ridges attached to it. As the air moves up and out of the digester cylinder it creates a void. As the bubbles travel up through the chamber, solids are pulled from the bottom, up through the chamber and across the stationary ridges or blades. These solids are traveling at speeds up to 65 ft./sec. when they hit the stationary blades and are thereby broken up.

The present invention is driven by an approximately 1 hp commercial-grade, regenerative air blower. The only required maintenance is to periodically (every three months) check and clean as necessary the small air intake filter. There is no maintenance on the present invention after installation is complete. Simply insert the present invention in the septic tank and let it run. The present invention is designed to run 24/7 with "0" maintenance. Due to its super efficiency, it is recommended that the unit be wired with a timer to allow it to run 3 to 4 hours per day, every other day.

The present invention quickly breaks solids down allowing high concentrations of oxygen to penetrate the resulting smaller suspended particles. By injecting warm air at low pressure, this also accelerates good bacteria growth which is also essential to the digestive process of raw sewage. Furthermore, the present invention uses various air outlet holes to facilitate oxygen transfer and the movement of solids and liquids, i.e. fine bubbles are used for O2 transfer and course air bubbles increase velocity; and, it uses unique combinations of air pressure and water pressure in a confined chamber to maximize the absorption and transfer of oxygen to water and solids to facilitate the digestion process.

The estimated operation cost is based on the following information and may vary depending on your local utility rates. 1) a 1 hp motor with 7 cents kwh power cost calculates to an hourly cost of about 7 cents; 2) the daily cost is about 28 cents; and, 3) a run time of 4 hrs/day calculates to an annual cost of about $102.00 assuming an operating schedule of 365 days/year.

What is claimed to be new and desired to be protected by Letters Patent is set forth in the appended claims:

1. An apparatus for aerating a body of liquid, in which an air pump is used to supply air to the apparatus, comprising:

a) an upright standing aeration chamber having upper and lower ends, said aeration chamber having a circumferential wall;

b) a liquid inlet being disposed on said lower end of said aeration chamber and a liquid outlet being disposed on said upper end of said aeration chamber;

c) an upright standing air feed conduit having a bore and having upper and lower ends being substantially centrally disposed in said aeration chamber, said conduit having a plurality of air outlet apertures therein, wherein said plurality of air outlet apertures are disposed adjacent said lower end of said air feed conduit, said conduit having an air inlet on said upper end of said conduit;

d) a plurality of walls projecting radially from said air feed conduit, said walls extending from said upper to lower ends of said air feed conduit, each said wall having an end, wherein said end is contiguous to said wall of said aeration chamber, a plurality of partitions being disposed in said aeration chamber between each said wall;

e) an air manifold being disposed on said upper end of said air feed conduit, said manifold having upper and lower ends, said manifold having an air inlet on said upper end and an air outlet on said lower end, wherein said air outlet of said manifold connects to said air inlet of said conduit so that air can flow from said air inlet of said manifold to said air outlet apertures of said air feed conduit; and, f) an impingement member being disposed between said upper end of said air manifold and said liquid outlet so that the body of liquid is impinged against said impingement member, wherein the body of liquid is aerated.

2. The apparatus of claim 1, wherein said liquid inlet further comprises a plurality of liquid inlet apertures, said inlet apertures of said liquid inlet being disposed in said wall of said aeration chamber so that each said partition has one liquid inlet aperture for inletting liquid to said partition.

3. The apparatus of claim 1, wherein there are three said partitions.

4. The apparatus of claim 1, wherein said impingement member comprises a plurality of concentric ridges, wherein said ridges are disposed on said lower end of said manifold and each successively higher said ridge has a greater diameter than the preceding lower said ridge.

5. The apparatus of claim 1, further comprising a weighted base being disposed on said lower end of said aeration chamber so that said aeration chamber is substantially stationary in the body of liquid.

6. A method for aerating a body of liquid, in which an air pump is used to supply air, comprising the steps of:

a) providing an upright standing aeration chamber having upper and lower ends, the aeration chamber having a circumferential wall;

b) providing a liquid inlet on the lower end of the aeration chamber and a liquid outlet on the upper end of the aeration chamber;

c) providing an upright standing air feed conduit having a bore and having upper and lower ends being substantially centrally disposed in the aeration chamber, the conduit having a plurality of air outlet apertures therein, wherein the plurality of air outlet apertures are disposed adjacent the lower end of the air feed conduit, the conduit having an air inlet on the upper end of the conduit;

d) providing a plurality of walls projecting radially from the air feed conduit, the walls extending from the upper to lower ends of the air feed conduit, each wall having an end, wherein the end is contiguous to the wall of the aeration chamber, wherein a plurality of partitions are formed between the walls in the aeration chamber so that the number of partitions equals the number of walls;

e) providing an air manifold on the upper end of the air feed conduit, the manifold having upper and lower ends, the manifold having an air inlet on the upper end and an air outlet on the lower end, wherein the air outlet of the manifold connects to the air inlet of the conduit so that air can flow from the air inlet of the manifold to the air outlet apertures of the air feed conduit; and, f) providing an impingement member between the upper end of the air manifold and the liquid inlet so that the body of liquid is impinged against the impingement member, wherein the body of liquid is aerated.

7. The method of claim 6, wherein the liquid inlet further comprises the step of providing a plurality of liquid inlet apertures, the inlet apertures of the liquid inlet being disposed in the wall of the aeration chamber so that each partition has one liquid inlet aperture for inletting liquid to the partition.

8. The method of claim 6, wherein there are three partitions.

9. The method of claim 6, further comprising the step of providing a plurality of concentric ridges on the impingement member wherein the ridges are disposed on the lower end of the manifold and each successively higher ridge has a greater diameter than the preceding lower ridge.

10. The method of claim 6, further comprising the step of providing a weighted base on the lower end of the aeration chamber so that the aeration chamber is substantially stationary in the body of liquid.

11. The method of claim 6, wherein the walls are integrally formed with the air feed conduit.

* * * * *